US007786838B2

(12) United States Patent
Nakada et al.

(10) Patent No.: US 7,786,838 B2
(45) Date of Patent: Aug. 31, 2010

(54) WIRE WOUND ELECTRONIC PART

(75) Inventors: Yoshinari Nakada, Gunma (JP); Takayuki Maruyama, Gunma (JP); Hideharu Suzuki, Gunma (JP); Koihci Iguchi, Takasaki (JP); Takahiro Samata, Takasaki (JP); Satoshi Kimura, Gunma (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 12/197,941

(22) Filed: Aug. 25, 2008

(65) Prior Publication Data

US 2009/0058591 A1 Mar. 5, 2009

(30) Foreign Application Priority Data

Sep. 5, 2007 (JP) ..... 2007-230303

(51) Int. Cl.
*H01F 5/00* (2006.01)

(52) U.S. Cl. ..... 336/200; 336/223; 336/232; 29/602.1

(58) Field of Classification Search ..... 29/602.1
See application file for complete search history.

(56) References Cited

U.S. PATENT DOCUMENTS 5,708,331 A * 1/1998 Vamvakas et al. ..... 315/248
2005/0046536 A1* 3/2005 Ritter et al. ..... 336/200
2005/0212643 A1* 9/2005 Kuroiwa et al. ..... 336/200

FOREIGN PATENT DOCUMENTS

JP 03-106005 5/1991
JP 2007-214521 8/2007

* cited by examiner

*Primary Examiner*—Anh T Mai
(74) *Attorney, Agent, or Firm*—Law Office of Katsuhiro Arai

(57) ABSTRACT

A wire wound electronic part includes a ferrite core comprising ferrite having a columnar wire wound core and flanges formed at both ends thereof, a coil conductor wound around the wire wound core of the ferrite core, and at least a pair of terminal electrodes having a Cu conduction layer disposed to the outer surface of the flange, in which both ends of the coil conductor wound around the wire wound core are conductively connected to the terminal electrodes. The terminal electrode is formed by coating an electrode paste containing a Cu powder and a glass frit to the outer surface of the ferrite core, and then applying a heat treatment to the ferrite core. There is a reaction layer of a portion of the ferrite core and the glass frit at a boundary between the ferrite core and the Cu conduction layer. The terminal electrodes has the peel strength identical with that of an existent Ag terminal electrode, without forming a plate layer.

12 Claims, 5 Drawing Sheets

[Fig. 1]
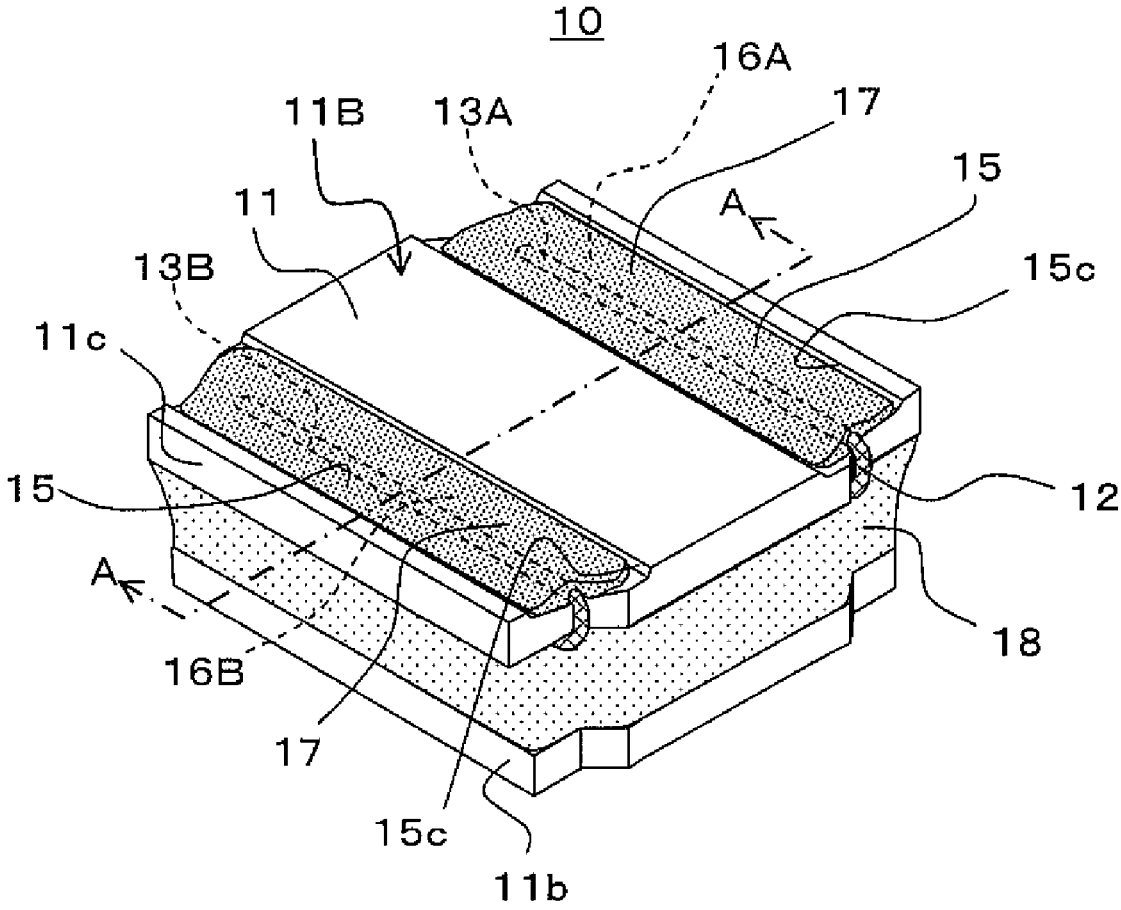

[Fig. 2]
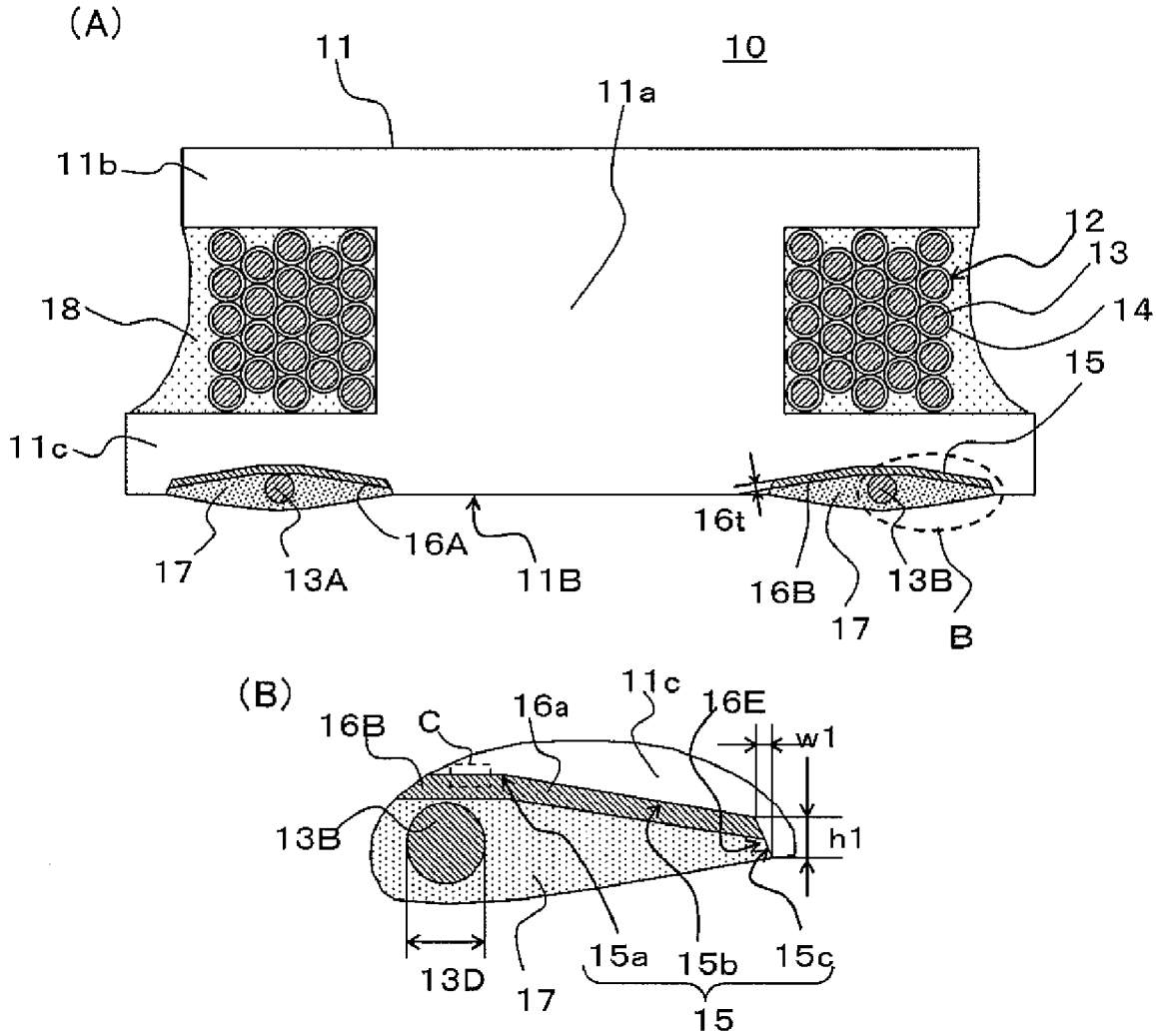

[Fig. 3]
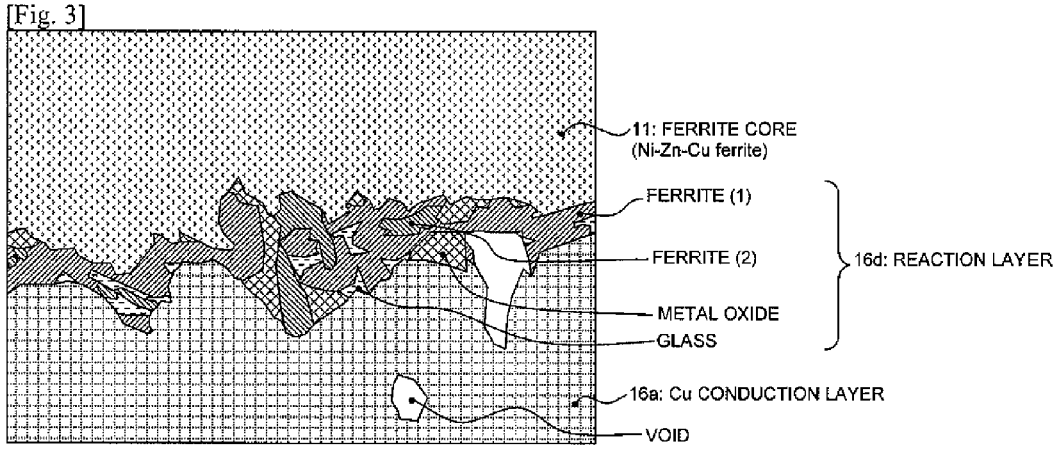
[Fig. 4]
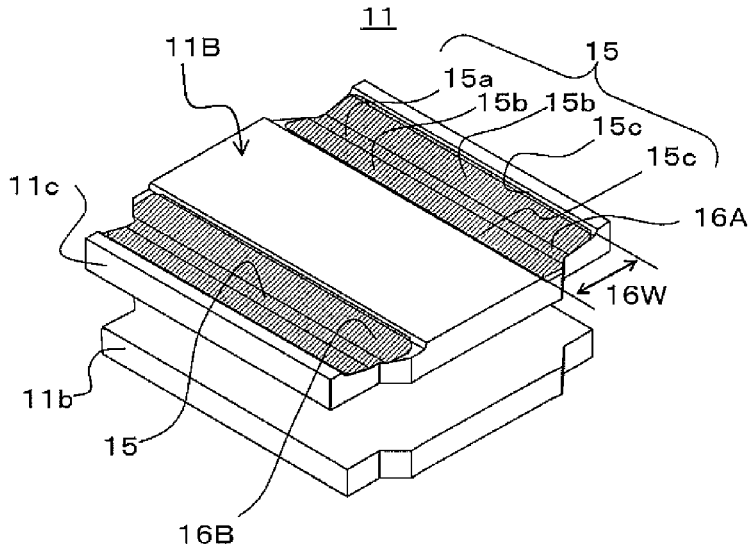

[Fig. 5]
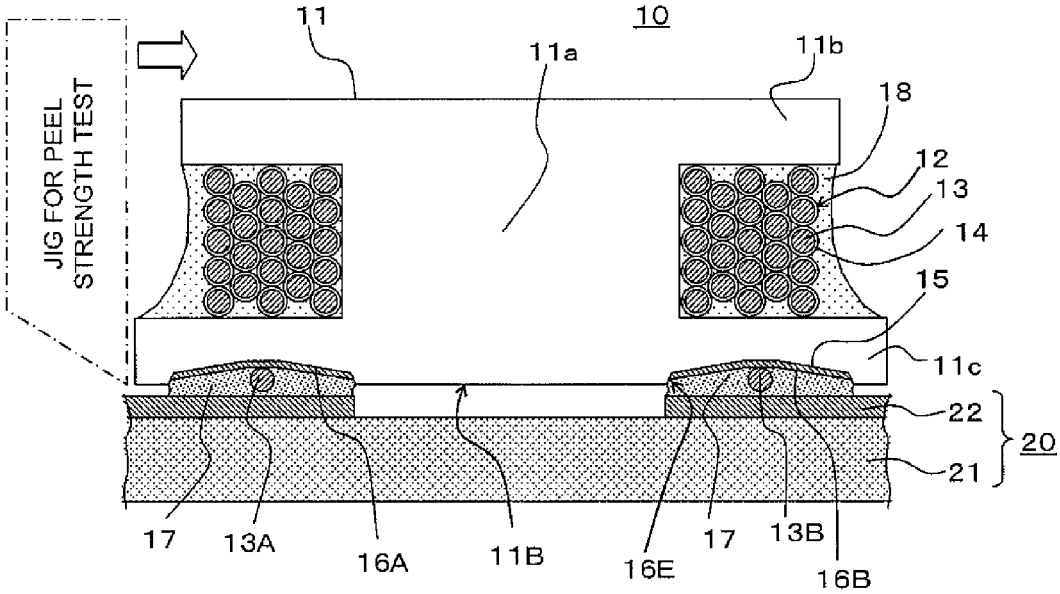
[Fig. 6]
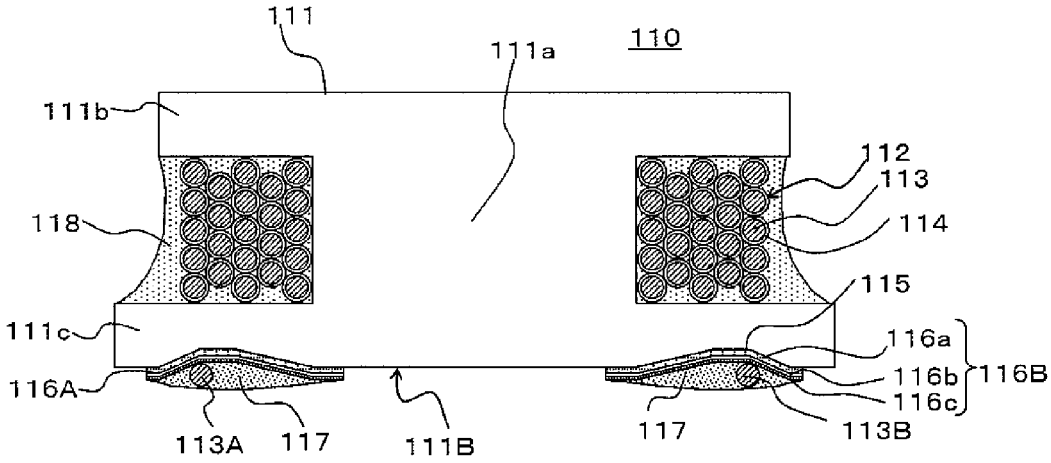
PRIOR ART

[Fig. 7]
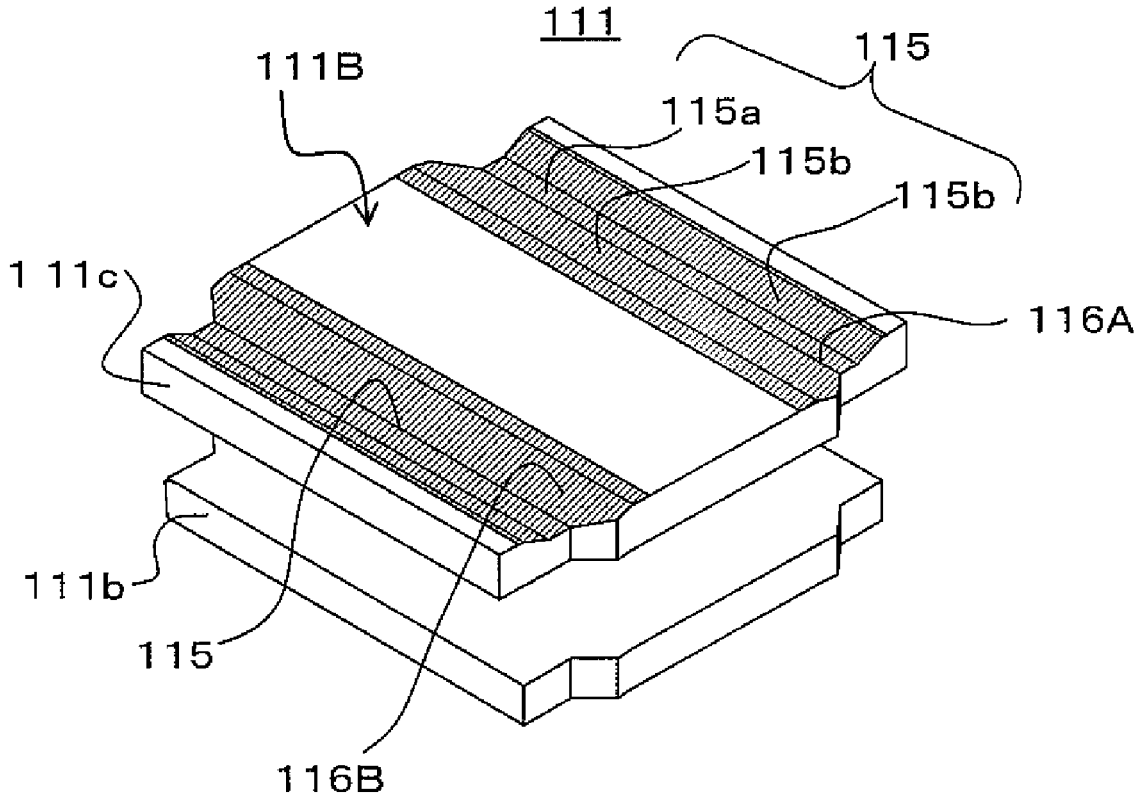
PRIOR ART

WIRE WOUND ELECTRONIC PART

BACKGROUND OF THE INVENTION

1. Field of the Invention

The present invention concerns a wire wound electronic part used, for example, in mobile electronic equipments or thin electronic equipments.

2. Description of the Related Technology

Wire wound type electronic parts are used as step up circuit coils for DC/DC power sources in cellular phones or mobile electronic equipments such as digital still cameras and choke coils in peripheral circuits of various kinds of flat panel displays. For the application uses described above, it is particularly demanded for those having a small and low-profile dimension capable of high density mounting or low-profile mounting while ensuring desired inductor characteristics.

Japanese Unexamined Patent Publication No. 2007-214521 discloses an example of a wire wound electronic part, a wire wound electronic part has, for example, a ferrite core, a pair of terminal electrodes disposed to the ferrite core and a coil conductor wound around the ferrite core and connected at the ends thereof to the terminal electrodes. The ferrite core includes a wire wound core, an upper flange disposed to the upper end of the wire wound core and a lower flange disposed to the lower end of the wire wound ferrite core. A pair of the terminal electrodes are formed on the bottom of the lower flange of the ferrite core. The terminal electrode is formed by coating an electrode paste mainly comprising Ag to the bottom of the lower flange of the ferrite core and then applying a heat treatment to the ferrite core, for example, in atmospheric air at 650° C., and has an Ag conduction layer. Further, in the terminal electrode, an Ni plating layer and a solder plating (Sn plating) layer are formed, for example, on the surface of the Ag conduction layer. The coil conductor comprises a metal wire having an insulation coating formed at the outer circumference thereof and is wound around the periphery of the wire wound core of the ferrite core. Then, one and the other ends of the coil conductor are removed with the insulation coating and connected to the terminal electrodes in which a plating layer is formed respectively by soldering.

FIG. 6 and FIG. 7 are views showing an example of the wire wound electronic part. FIG. 6 is a vertical cross sectional view taken along a central axis of a wire wound core 111*a* showing the inner structure of the wire wound electronic part 110. FIG. 7 is a perspective view for the appearance of a lower flange 111*c* of a ferrite core 111 used for the wire wound electronic part 110 as viewed on the side of the bottom 111B.

As shown in FIG. 6, it specifically discloses a wire wound electronic part 110 including the ferrite core 111 having a columnar wire wound the ferrite core 111*a* and flanges 111*b*, 111*c* formed at upper and lower ends thereof a coil conductor 112 wound around the wire wound core 111*a* of the ferrite core 111, and terminal electrodes 116A, 116B disposed at a bottom 111B crossing the wire wound core 111*a* of the flange 111*c*, in which both ends 113A, 113B of the coil conductor 112 wound around the wire wound core 111*a* are conductively connected to the terminal electrodes 116A, 116B by using solders 117, 117.

Then, as shown in FIG. 7, a pair of grooves 115, 115 are formed to the bottom 111B of the flange 111*c* of the ferrite core 111, and the groove 115 has a bottom 115*a*, and moderate slopes 115*b*, 115*b* disposed on both lateral sides of the bottom 115*a* being slanted to the bottom 115*a*. Then, the terminal electrodes 116A and 116B are formed so as to extend from a position above one moderate slope 115*b* of the groove 115 by way of the bottom 115*a* of the groove 115 to a position above the other moderate slope 115*b*.

Then, the terminal electrodes 116A, 116B have, as shown in FIG. 6, an Ag conduction layer 116*a* formed by coating the electrode paste mainly comprising Ag to the bottom of the lower flange 111*c* of the ferrite core 111 and then applying a heat treatment to the ferrite core 111, for example, in atmospheric air, and an Ni plating layer 116*b* and an Sn plating layer 116*c* formed on the surface of the Ag conduction layer 116*a*.

Further, Japanese Unexamined Patent Publication No. Hei 3-106005 proposes to adopt a Cu conduction layer instead of the existent Ag conduction layer in a composite electronic part in the application use different from the existent wire wound electronic part.

Specifically, it proposes a method of manufacturing a chip type LR filter by baking a core in air or an oxygen atmosphere, coating a conductive paste mainly comprising silver, silver-palladium, or copper to the outer surface of a flange of the baked core to form a pair of lead wire extending electrodes, and then baking the core in a reducing atmosphere such as $H_2$ or CO gas, or in a neutral atmosphere such as an $N_2$ or Ar gas at an oxygen concentration of 0.1% or less, thereby forming the lead extending electrode to the core and lowering the resistance of the core and, further, applying winding to a wire wound portion.

In the existent wire wound electronic part, when the thickness of the flange is decreased for lower-profile of the ferrite core, this brings about a possibility of generating flange fracture upon forming the Ni plating layer and the Sn plating layer on the Ag conduction layer.

For saving the plating layer, use of an Ag—Pd conduction layer or a Cu conduction layer instead of the Ag conduction layer is prospective.

However, as described in JP-A No. Hei 3-106005, in a case, for example, of coating a conductive paste mainly comprising copper to the outer surface of the flange of the core to form a pair of lead wire extending electrodes, then baking the core in a reducing atmosphere such as an $H_2$ or Co gas or in a neutral atmosphere such as $N_2$ or Ar gas at an oxygen concentration of 0.1% or less thereby forming the lead extending electrode to the core and lowering the resistance of the core, insulation performance between a pair of terminal electrode is lowered. Accordingly, this results in a problem that they cannot be used in a choke coil or the like for a power source used for certain commercial applications.

SUMMARY OF CERTAIN INVENTIVE ASPECTS

Certain inventive aspects, taking notice on the problem described above, provide a wire wound electronic part capable of solder bonding the ends of a coil conductor without forming a plating layer in the same manner as an existent terminal electrode in which the Ni plating layer and Sn plating layer are disposed successively on the Ag conduction layer, and having a terminal electrode with a peel strength comparable with that of the existent product.

For attaining the foregoing object, the present inventors have made an earnest study and, as a result, have found a new terminal electrode structure capable of solder bonding the ends of coil conductor in the same manner as the existent Ag electrode and having a peel strength identical with that of the existent part, without forming the plating layer by devising the electrode paste and the heat treatment condition.

The foregoing object is attained in a first aspect of the present invention by a wire wound electronic part including a ferrite core having a columnar wire wound core and flanges formed at both ends thereof, a coil conductor wound around the wire wound core of the ferrite core, and at least a pair of terminal electrodes having a Cu conduction layer disposed to the outer surface of the flange, in which both ends of the coil conductor wound around the wire wound core are conductively connected to the terminal electrode, wherein the terminal electrode is formed by coating an electrode paste containing a Cu powder and a glass frit to the outer surface of the ferrite core, and then applying a heat treatment to the ferrite core, and has a reaction layer of a portion of the ferrite core and the glass frit at the boundary between the ferrite core and the Cu conduction layer.

In one aspect, the terminal electrode is formed by coating an electrode paste containing the Cu powder and the glass frit to the outer surface of the ferrite core and then applying a heat treatment to the ferrite core and has a reaction layer of a portion of the ferrite core and the glass frit at the boundary between the ferrite core and the Cu conduction layer. Accordingly, it is possible to provide a wire wound electronic part having terminal electrodes that can be solder bonded with the ends of the coil conductor in the same manner as in the existent Ag terminal electrodes without forming the plating layer and having a peel strength comparable with that of the existent Ag terminal electrode.

In one main embodiment as a second aspect according to the first aspect of the wire wound electronic part, the reaction layer is a layer in which the glass frit contained in the electrode paste and the portion of the ferrite core take place a chemical reaction and are present being mixed to each other, which mainly comprises the ferrite and the glass. Accordingly, the Cu conduction layer and the ferrite core are secured firmly.

Further, in another main embodiment as a third aspect according to the second aspect of the wire wound electronic part, the reaction layer has a region in which the ferrite core and the Cu conduction layer are bonded with ferrite. Accordingly, the Cu conduction layer and the ferrite core are secured more firmly without adding a great amount of glass. This can provide a terminal electrode with good solder wettability.

Further, in a further main embodiment as a fourth aspect according to the first aspect of the wire wound electronic part, the ferrite constituting the ferrite core is an Ni—Zn type ferrite, and the glass frit is a glass frit containing boron and zinc. Accordingly, the glass frit contained in the electrode paste and a portion of the ferrite core take place a chemical reaction and are mixed to each other thereby tending to form a reaction layer mainly comprising the ferrite and the glass.

Further, in a further main embodiment as a fifth aspect according to any one of first to fourth aspects of the wire wound electronic part, the heat treatment for the ferrite core after coating the electrode paste to the outer surface is a heat treatment conducted at an $N_2$ gas atmosphere in an oxygen gas concentration of 10 ppm or less at 850 to 900° C. Accordingly, the boundary between the Cu conduction layer and the ferrite core is filled with the reaction layer.

The reaction layer may further contain a metal oxide. This enhances the fixing strength between the Cu conduction layer and the ferrite core.

The foregoing and other objects, features, functions, and effects of certain inventive aspects will become apparent from the following descriptions taken in connection with the accompanying drawings.

BRIEF DESCRIPTION OF THE DRAWING

FIG. 1 is a perspective view for the appearance showing the entire structure of a first embodiment of a wire wound electronic part;

FIG. 2 is a vertical cross sectional view showing the inner structure of the wire wound electronic part of the first embodiment;

FIG. 3 is a view depicting an SEM photograph for the boundary between a ferrite core and a Cu conduction layer of the wire wound electronic part of the first embodiment;

FIG. 4 is a perspective view for the appearance showing a ferrite core used for the wire wound electronic part of the first embodiment;

FIG. 5 is a vertical cross sectional view showing the state of mounting the wire wound electronic part of the first embodiment above a circuit substrate;

FIG. 6 is a vertical cross sectional view showing an example of a wire wound electronic part in the existent art;

FIG. 7 is a perspective view for the appearance showing a ferrite core used for the wire wound electronic part of the existent technique.

DETAILED DESCRIPTION OF CERTAIN INVENTIVE EMBODIMENTS

A first embodiment of a wire wound electronic part is to be described with reference to FIG. 1 to FIG. 5. FIG. 1 is a perspective view for the appearance for explaining the entire structure of a wire wound electronic part 10 of a first embodiment as viewed on the side of a bottom 11B having a pair of terminal electrodes 16A, 16B. FIG. 2 is view for explaining the internal structure of the wire wound electronic part 10 of this embodiment in which FIG. 2A is a vertical cross sectional view taken along a central axis of a wire wound core 11*a* of the wire wound electronic part 10 and FIG. 2B is an enlarged cross sectional view showing a region surrounded by a broken line B in FIG. 2A for the wire wound electronic part 10.

FIG. 3 is a view schematically depicting a photograph taken for a region surrounded by a broken line C in FIG. 2B for the wire wound electronic part 10 by a scanning type electron microscope (SEM) and applying hatchings which are different on every composition based on the result of EDX analysis. Further, FIG. 4 is a perspective view for the appearance of the ferrite core 11 after forming a pair of terminal electrode 16A, 16B used for the wire wound electronic part 10 of this embodiment as viewed on the side of the bottom 11B of the lower flange 11*c* of the ferrite core 11. FIG. 5 is a vertical cross sectional view for a main portion showing a state of mounting the wire wound electronic part 10 above a circuit substrate 20 in which a mounting land 22 is formed on one main surface of a substrate 21.

The constitutions and the effects of certain embodiments are not restricted to those in FIG. 1 to FIG. 5.

As shown in FIG. 1 to FIG. 5, the wire wound electronic part 10 of this embodiment includes a ferrite core 11, coil conductor 12 wound around the ferrite core 11 and a pair of terminal electrodes 16A, 16B having a Cu conduction layer 16*a* connected to the ends 13A, 13B of the coil conductor 12 in which a magnetic powder-containing resin 18 is further coated so as to cover the wound type electronic part 12.

More specifically, as shown in FIG. 2, the ferrite core 11 includes a columnar wire wound core 11*a*, an upper flange 11*b* disposed at the upper end of the wire wound core 11*a* and a lower flange 11*c* disposed to the lower end of the wire wound core 11*a*. Then, a pair of grooves 15, 15 are formed to the bottom 11B crossing the central axis of the wire wound core 11*a* of the lower flange 11*c* of the ferrite core 11 while putting therebetween an extension line from the central axis of the wire wound core 11*a*.

The grooves 15, 15 include, respectively, as shown in FIG. 4, a bottom 15*a*, side walls 15*c*, 15*c* on both lateral sides of the bottom 15*a* being slanted to the bottom 15*a*, and moderate slopes 15*b*, 15*b* disposed between the bottom 15*a* and the side walls 15*c*, 15*c*.

Further, the pair of terminal electrodes 16A, 16B are contained for all the regions from one end to the other end in the lateral direction within the groove 15. Then, the edge portions 16E in the lateral direction of the terminal electrodes 16A, 16B are restricted by the side walls 15*c*, 15*c* of the groove 15.

In the wire wound electronic part 10 of this embodiment, the terminal electrodes 16A, 16B having the Cu conduction layer are formed by coating the electrode paste containing the Cu powder and the glass frit to the outer surface of the ferrite core 11 and then applying a heat treatment to the ferrite core 11. Then, as shown in FIG. 3, they contain the reaction layer 16*d* of a portion of the ferrite core 11 and the glass frit at a boundary between the ferrite core 11 and the Cu conduction layer 16*a*.

Further, the reaction layer 16*d* is a layer in which the glass frit contained in the electrode paste and a portion of the ferrite core 11 take place a chemical reaction and are present being mixed to each other, and mainly comprises ferrite and glass.

Further, the reaction layer 16*d* includes a region of bonding the ferrite core 11 and the Cu conduction layer 16*a* by the ferrite.

Further, the ferrite constituting the ferrite core 11 is an Ni—Zn type ferrite and, more specifically, the Ni—Zn—Cu type ferrite.

Further, the glass frit in the electrode paste is a glass frit containing boron and zinc.

Further, the reaction layer 16*d* contains a metal oxide.

Further, the heat treatment for the ferrite core 11 after coating the electrode paste to the outer surface is a heat treatment conducted in an $N_2$ gas atmosphere at an oxygen concentration of about 10 ppm or less at about 850 to 900° C.

Further, the coil conductor 12 comprises a metal wire 13 having an insulation coating 14 being formed at the outer periphery thereof and is wound around the periphery of the columnar wire wound core 11*a* of the ferrite core 11, and connected by solders 17, 17 to the terminal electrodes 16A, 16B respectively in a state where the insulation coating 14 is removed at one and the other ends 13A, 13B.

A preferred embodiment for the ferrite core 11 is as described below, That is, the ferrite core 11 preferably comprises a soft magnetic material, for which a high permeability magnetic material comprising Ni—Zn type ferrite, particularly, Ni—Zn—Cu type ferrite as a main ingredient is more preferred. After mixing a powder of the magnetic material and a binder and pelleting them, a square columnar molding product is formed by using a powder molding press, and a recess is formed by centerless grinding using a grinding disk to obtain a drum-shaped molding product. Then, after applying a debinding treatment to the obtained drum-shaped molding product at about 800° C., it is baked at a predetermined temperature depending on the sintering temperature of the magnetic material to obtain the ferrite core 11. Further, the method of forming the drum-shaped molding product is not restricted to the method of forming a recess to the peripheral lateral surface of the square columnar molding product by centerless grinding but it can be obtained also by pelletting in the same manner as described above and then by dry one-piece molding using a powder molding press. Further, the method of forming the ferrite core 11 is not restricted to the method of previously providing a drum-shaped molding product and baking the same, but it may be formed also by a method, for example, of providing a square columnar molding product in the same manner as described above, then applying the debinding treatment in the same manner as described above, baking at a predetermined temperature, and then forming a recess by grinding fabrication to the peripheral lateral surface of the square columnar sintered magnetic product by using a diamond wheel or the like.

The wire wound core 11*a* of the ferrite core 11 preferably has a substantially circular or circular cross sectional shape such that the length of the coil conductor 12 necessary for obtaining a predetermined number of turns can be made shorter, but this is not restrictive and it may be changed properly while considering the durability of the molding die or easy deburring, particularly, in a case of manufacture by a method of obtaining a drum shaped molding product by dry one-piece molding.

Preferably, the outer shape of the lower flange 11*c* of the ferrite core 11 is substantially square shape or a square shape in a plan view for size-reduction corresponding to high density mounting, but this is not restrictive and it may be a polygonal or substantially circular shape. Further, the outer shape for the upper flange 11*b* of the ferrite core 11 preferably has a shape similar with the lower flange 11*c* and preferably has a size equal with that of the lower flange 11*c* and a size somewhat smaller than the lower flange portion 11*c* for decreasing the size corresponding to high density mounting. Further, four corners of the upper flange 11*b* are preferably chamfered for facilitating filling of the magnetic powder-containing resin 18 between the upper flange 11*b* and the lower flange 11*c*.

Further, the thickness for the upper flange 11*b* and the lower flange 11*c* is preferably about 0.5 mm or less respectively for providing a low-profile wire wound electronic part 10. On the other hand, the lower limit for the thickness of the upper flange 11*b* and the lower flange 11*c* is preferably set so as to satisfy a predetermined strength while considering the protruding size of the upper flange 11*b* and the lower flange 11*c* respectively from the wire wound core 11*a* of the core 11.

A preferred embodiment for the grooves 15, 15 is as described below. That is, the grooves 15, 15 are preferably formed at least by one pair to the bottom 11B of the lower flange 11*c* of the ferrite core 11. Further, the grooves 15, 15 are preferably formed by at least one pair so as to put therebetween an extension line from the central axis of the wire wound core 11*a*.

For the depth of the grooves 15, 15, they are preferably formed such that a portion of the diameter 13D at the ends 13A, 13B of the coil conductor 12 protrudes from the groove 15 exceeding the position for the height on the flat surface of the bottom 11B in a state where the terminal electrodes 16A, 16B are formed on the bottom 15*a* of the groove 15.

Further, both ends of the grooves 15, 15 in the longitudinal direction preferably reach a pair of outer lateral surfaces of the lower flange 11*c* opposed to each other.

Further, the grooves 15, 15 preferably have bottoms 15*a* which situate substantially at the center in the lateral direction of the grooves 15, 15 and are substantially in parallel with the bottom 11B of the lower flange 11*c*, and side walls 15*c*, 15*c* disposed on both lateral sides of the bottom 15*a* and disposed being slanted to the bottom 15*a*.

Further, the grooves 15, 15 preferably have moderate slopes 15*b*, 15*b* between the bottoms 15*a* and the side walls 15*c*, 15*c*. When assuming the moderate slope 15*b* as a hypotenuse of a right triangle and defining the same with a length for the bottom and the height in the vertical direction (vertical height) of the right triangle, the length for the bottom of the moderate slope 15*b* is preferably larger than the vertical height of the moderate slope.

Further, the method of forming the groove 15 to the bottom 11B may include a method of previously providing a pair of ridges to a surface of a pressing die upon forming the square columnar molding product and forming the groove simultaneously with the molding of the molding product in the step of manufacturing the core 11, as well as a pair of grooves may be formed, for example, by applying a cutting fabrication to the surface of the obtained square columnar molding product.

Then, a preferred embodiment for the side wall 11*c* of the groove 15 is as described below. That is, assuming the side wall 15*c* of the groove 15 as a hypotenuse of a right triangle and defining the same with the length w1 for the bottom and the height h1 in the vertical direction (vertical height) of the right triangle, the vertical height h1 for the side wall 15*c* is preferably larger than the length w1 for the side wall 15*c*.

Further, the vertical height h1 for the side walls 15*c*, 15*c* is preferably larger than the thickness for the terminal electrodes 16A, 16B to be described later.

Further, the length w1 for the bottom of the side walls 15*c*, 15*c* is preferably smaller than the diameter 13D at the ends 13A, 13B of the coil conductor 12 to be described later.

A preferred embodiment of the terminal electrodes 16A, 16B is as described below. That is, the terminal electrodes 16A, 16B are preferably those formed by coating an electrode paste containing a Cu powder and a glass frit to the bottom 11B of the lower flange 11*c* of the ferrite core 11 and then applying a heat treatment to the ferrite core 11, and preferably have a reaction layer 16*d* of a portion of the ferrite core 11 and the glass frit at the boundary between the ferrite core 11 and the Cu conduction layer 16*a*.

Further, the reaction layer 16*d* is preferably a layer in which the glass frit contained in the electrode paste and a portion of the ferrite core 11 take place a chemical reaction and are present being mixed to each other, and the reaction layer 16*d* preferably comprises mainly ferrite and glass. Further, it is preferred that the reaction layer 16*d* further contains a metal oxide. The metal oxide is, preferably, at least one member of CaO, BaO, MgO, CuO, and $Cu_2O$.

A preferred embodiment of the electrode paste is as described below. That is, the electrode paste preferably contains a Cu powder and a glass frit and the glass frit is more preferably a glass frit containing boron and zinc. The glass frit, for example, is preferably at least one member of zinc borate type glass frit, zinc borosilicate type glass frit, and zinc borobismuthate type glass frit.

Further, the metal oxide may also be added previously to the electrode paste.

The heat treatment for the ferrite core 11 after coating the electrode paste to the outer surface is preferably a heat treatment conducted in an $N_2$ gas atmosphere at an oxygen concentration of about 10 ppm or less at about 850 to 900° C. and, the oxygen concentration in the atmosphere is more preferably 1 ppm or less.

The thickness 16*t* of the terminal electrodes 16A, 16B is preferably smaller than the vertical height h1 for the side wall 15*e* of the groove 15.

The method of forming the terminal electrodes 16A, 16B may include a transfer method such as a roller transfer method or a pad transfer method and a printing method such as a screen printing method or a stencil printing method, as well as a spray method, an ink jet method or the like. Among them, the transfer method is more preferred for forming a terminal electrode of a stable lateral size which is contained in the groove 15 with the edge portion 16E being restricted by the side wall 15*c*.

In the explanation described above, "contained in the groove 15" means a state in which the edge portion 16E in the lateral direction of the terminal electrodes 16A, 16B does not exceed the end of the side wall 15*c* of the groove on the side of the bottom 11B.

Further, in the explanation described above, "restricted by the side wall 15*c*" means a state that the edge portion 16E in the lateral direction of the terminal electrodes 16A, 16B reaches at least a position above the side wall 15*c* except for the vicinity of both ends in the longitudinal direction, and the edge portion 16E in the lateral direction does not override the end of the side wall 15*c* on the side of the bottom 11B.

Then, a preferred embodiment of the coil conductor 12 is as described below. That is, the coil conductor 12 is wound around the periphery of the wire wound core 11*a* of the core 11 and preferably has an insulation cover 14 comprising a polyurethane resin or polyester resin at the outer periphery of the metal wire 13.

Further, the metal wire 13 for the coil conductor 12 is not restricted to as single wire but may also be a twisted wire. Further, the cross sectional shape of the metal wire 13 of the coil conductor 12 is not restricted to a circular shape but a flat square wire of a rectangular cross sectional shape or a square wire of a square cross sectional shape may also be used.

The diameter 13D at the ends 13A, 13B of the coil conductor 12 is preferably larger than the length w1 for the bottom of the side wall 15*c* of the groove 15.

In the foregoings, the conductive connection using the solder is not restricted to conductive connection only by soldering but may be any conductive connection so long as the terminal electrodes 16A, 16B and the ends 13A, 13B of the coil conductor 12 have a portion connected conductively by way of the solder. For example, it may be such a structure that the terminal electrodes 16A, 16B and the ends 13A, 13B of the coil conductor 12 have a portion bonded by inter-metal bonding by hot press bonding and covered with the solder so as to cover the bonded portion.

A preferred embodiment of the magnetic powder-containing resin 18 is as described below. That is, as the magnetic powder-containing resin 18, those having a viscoelasticity within a range of working temperature of the wire wound electronic part 10 are preferred. More specifically, a magnetic powder-containing resin having a glass transition temperature of about −20° C. or lower in the course of transition from a glassy state to a rubbery state upon change of the modulus of rigidity to the temperature as the physical property during curing is preferred, and a magnetic powder-containing resin having a glass transition temperature of about −50° C. or lower in the course of transition from the glassy state to the rubbery state upon change of the modulus of rigidity to the temperature as the physical property during curing is more preferred. As the resin used for the magnetic powder-containing resin 18, a silicone resin is preferred, and a resin mixture of an epoxy resin and a carboxyl group-modified propylene glycol is more preferred since the lead time for the step of intruding the magnetic powder-containing resin 18 between the flanges 12, 13 can be shortened.

As the magnetic powder used for the magnetic powder-containing resin 18, various kinds of magnetic powders can be used. Specifically, one member or plurality of members in admixture selected from the powder of Ni—Zn type ferrite, the powder of Ni—Zn—Cu type ferrite, the powder of Mn—Zn type ferrite, the metal magnetic powder, etc. are used preferably. The grain size of the magnetic powder is preferably from about 5 to 20 μm. The content of the magnetic powder in the magnetic powder-containing resin 18 is preferably from about 30 to 85 wt %.

As a method of covering the magnetic powder-containing resin 18 on the outer periphery of the coil conductor 12 in a region wound around the periphery of the wire wound core 11*a* of the core 11, it is preferred, for example, to discharge a paste of the magnetic powder-containing resin 18 to the outer periphery of the coil conductor 12 by a dispenser and curing the same.

Example

At first, a commercially available polyurethane-coated coil conductor 12 in which an insulation coating 14 comprising a polyurethane resin of 6 μm thickness is formed at the outer periphery of a metal wire 13 comprising Cu having a circular cross sectional shape of 85 μm diameter is prepared.

Further, as the ferrite core 11, a powder of an Ni—Zn—Cu type ferrite material having a composition comprising NiO (21.0 mol %), ZnO (23.0 mol %), CuO (7.0 mol %), and $Fe_2O_3$ (49.0 mol %) is used as the magnetic material, which is mixed with the organic binder for powder molding to prepare a square columnar molding product, a recess is formed to the peripheral lateral surface of the molding product by using a grinding wheel and, after applying a debinder treatment at 800° C., it is baked at 1050° C. to provide a square ferrite core 11 having an outer diameter of 4.0 mm square and the thickness of 0.3 mm for the upper flange 11*b* and the lower flange 11*c* respectively, and the height of 0.4 mm for the wire wound core 11*a* and a diameter of 2.0 mm for the wire wound core 11*a*.

A pair of grooves 15, 15 are formed so as to sandwich the extension line from the central axis of the wire wound core 11*a* at the bottom 11B of the lower flange 11*c* of the obtained ferrite core 11. Referring to the size of the groove 15 the width for the deepest bottom 15*a* is 0.2 mm, the moderate slope 15*b*, 15*b* disposed on both sides of the bottom 15*a* have a length for the bottom of 0.3 mm respectively, and the height in the vertical direction (vertical height) is 0.1 mm. Further, the lateral walls 15*c*, 15*c* disposed on both sides in the lateral direction of the groove 15 have a length w1 for the bottom of 0.02 mm, and the height in the vertical direction (vertical height) h1 of 0.05 mm, and both ends in the longitudinal direction of the groove 15 respectively reach a pair of outer lateral surfaces opposed to each other of the lower flange 11*c*.

Then, as shown in Table 1, a Cu electrode paste formed by mixing 96 wt % of a Cu powder with an average grain size of 3 μm as the electrode paste, 3 wt % of zinc borobismuthate as a glass frit, 1 wt % of a metal oxide, and an appropriate amount of a vehicle was prepared.

TABLE 1

| | | Electrode Paste Composition (inorganic ingredient) | | | | |
|---|---|---|---|---|---|---|
| | Specimen No. | Metal powder | | Grass frit | | Metal oxide |
| | | Composition | Content (wt %) | Composition | Content (wt %) | Addition amount (wt %) |
| * | 1 | Cu | 96 | B, Bi, Zn type | 3 | 1 |
| * | 2 | Cu | 96 | B, Bi, Zn type | 3 | 1 |
| * | 3 | Cu | 96 | B, Bi, Zn type | 3 | 1 |
| | 4 | Cu | 96 | B, Bi, Zn type | 3 | 1 |
| | 5 | Cu | 96 | B, Bi, Zn type | 3 | 1 |
| ** | 6 | Ag | 96 | B, Zn, Na type | 4 | none |

** Comparative example
* Reference data

Then, after coating the Cu electrode paste for a width in contact with the side walls 15*c*, 15*c* on both lateral sides of the groove 15 by a roller transfer method, to the groove 15, the obtained ferrite core 11 is applied with a heat treatment in an $N_2$ gas atmosphere at an oxygen concentration of 1 ppm at each of temperatures of 700° C., 750° C., 800° C., 850° C., 900° C., to form a pair of terminal electrodes 16A, 16B. In this case, the edge portions 16E in the lateral direction of the terminal electrodes 16A, 16B are restricted within such a range as reaching the both side walls 15*c*, 15*c* in the lateral direction of the groove 15 respectively but not overriding the end of the side wall 15*c* on the side of the bottom 11B.

Then, a solder paste containing a flux is previously coated by a stencil printing method on the terminal electrodes 16A, 16B, the coil conductor 12 is wound around by 10 turns to the periphery of the wire wound core 11*a* of the ferrite core 11, and the insulation coating 14 on both ends of the coil conductor 12 is peeled by using a film peeling solvent DEPAINT (registered trade mark) KX manufactured by Sanei Kagaku Co., Ltd. Then, one end 13A and the other end 13B of the coil conductor 12 are pressed to the terminal electrodes 16A, 16B coated with the solder paste respectively by a soldering iron heated to 240° C. and conductively connected by using a solder.

Then, a magnetic powder-containing a resin paste is prepared by mixing 50% by weight of an Mn—Zn type ferrite powder, 5% by weight of a curing agent, and 10% by weight of a solvent to a resin formed by mixing an epoxy resin and a carboxyl group-modified propylene glycol at a 50:50 weight ratio, and discharged between the upper flange 11*b* and the lower flange 11*c* at the outer periphery of the coil conductor 12 for a wound region in the wire wound electronic part 10 of the embodiment described above by using a dispenser and cured by heating at 150° C. for one hour to obtain the wire wound electronic part 10.

After cutting the wire wound electronic part 10 of the specimen No. 4 obtained as described above along the central axis of the wire wound core 11*a* of the ferrite core 11, and polishing the cross section, a region surrounded with a broken line C in FIG. 2B is photographed by using a scanning type electron microscope (SEM). Then, the photograph is depicted and applied with hatchings which are different on every composition based on the result of EDX analysis and the result is shown in FIG. 3. In FIG. 3, the ferrite core 11 is shown in the upper portion and the Cu conduction layer 16*a* is shown in the lower portion of the drawing. Then, a reaction layer 16*d* exists at the boundary between the ferrite core 11 and the Cu conduction layer 16*a* in which the glass frit in the electrode paste and a portion of the ferrite core 11 take place a chemical reaction and are present being mixed to each other.

In the reaction layer 16*d*, ferrite (1), ferrite (2), and glass are observed and, further a metal oxide is also observed. It is judged from the result of EDX analysis that the ferrite (1) contains Cu and has a Zn-rich spinel structure: $(Ni,Zn)Fe_2O_4$. Further it is judged that the ferrite 2 contains Cu and has an Fe-rich spinel structure: $(Ni,Zn)Fe_2O_4$.

Then, in most of the regions in the reaction layer 16*d*, the ferrite core 11 and the Cu conduction layer 11*a* are bonded at least by way of one of the ferrite (1) and the ferrite (2). Further, the same reaction layer 16*d* is confirmed also in the specimen No. 5 wire wound electronic part 10.

Then, as shown in FIG. 5, after printing a cream solder on a circuit substrate 20 for peel strength test manufactured by RUMEX Inc. in which a mounting land 22 comprising a copper foil is formed on a glass-epoxy resin substrate 21, the wire wound electronic parts 10 obtained as described above are mounted by the number of 12, applied with reflow soldering at 245° C. and mounted. For the obtained circuit substrate mounted with the wire wound electronic, the wire wound electronic part 10 is pressed on the lateral side thereof in a direction of an arrow parallel with the circuit substrate 20 by a jig of a peel strength testing apparatus to conduct a peel strength test for the wire wound electronic part 10, the peel mode is confirmed by visual appearance test outer looking inspection and the obtained result is shown in Table 2.

the groove 115 of the ferrite core 111 for the wire wound electronic part of the existent structure shown in FIG. 7, the obtained ferrite core 111 is baked in an atmospheric air at 650° C. to form an Ag conduction layer 116*a*. Further, an Ni plating layer 116*b*, and an Sn plating layer 116*c* are formed successively on the Ag conduction layer 116*a* of the ferrite core 111 to obtain a core 111 having terminal electrodes 116A, 116B. A wire wound electronic part 110 of specimen No. 6 as a comparative example is prepared in the same manner as in the previous example except for using a ferrite core 111 having terminal electrodes 116A, 116B formed with the Ni plating layer 116*b* and the Sn plating layer 116*c* on the Ag conduction layer 116*a*.

Further, the wire wound electronic part 110 of the comparative example is mounted on a circuit substrate not illustrated in the same manner as the wire wound electronic part 10 of the example, and the peel strength and the peel mode of the wire wound electronic part 110 on the obtained circuit substrate where the wire wound electronic part is mounted with are measured in the same manner as described above and the results are shown in Table 2.

As shown in Table 2, it has been formed that the wire wound electronic parts of this embodiment in which a terminal electrode having the Cu conduction layer is formed by coating a Cu electrode paste containing a Cu powder, zinc

TABLE 2

| | Specimen No. | Heat Treatment Atmosphere Gas | Heat Treatment Atmosphere Oxygen concentration (ppm) | Heat Treatment Temperature (° C.) | Plating Layer Composition | Peel Strength (n =12) average (kg) | Peel Mode |
|---|---|---|---|---|---|---|---|
| * | 1 | $N_2$ | 1 ppm | 700 | non | 2.21 | Core-Cu Conduction boundary |
| * | 2 | $N_2$ | 1 ppm | 750 | non | 13.88 | Core-Cu Conduction boundary |
| * | 3 | $N_2$ | 1 ppm | 800 | non | 14.44 | Core-Cu Conduction boundary Core inside |
| | 4 | $N_2$ | 1 ppm | 850 | non | 19.79 | Core inside |
| | 5 | $N_2$ | 1 ppm | 900 | non | 20.41 | Core inside |
| ** | 6 | Atmospheric inside | | 650 | Ni, Sn | 17.30 | Core inside |

** Comparative example

* Reference data

In Table 2, "core-Cu conduction layer boundary" in the column for the peel mode indicates that peeling occurs at the boundary between the core and the Cu conduction layer. Further, "core-Cu conduction layer boundary, core inside" in the column for the peel mode as for specimen No. 3 shows that a portion peels at the boundary between the core and the Cu conduction layer and the remaining portion is broken at the inside of the core.

Comparative Example

As shown by specimen No. 6 in Table 1, an Ag electrode paste is formed by mixing 96 wt % of an Ag powder with an average grain size of 30 μm, 4 wt % of B, Zn, Na type glass frit as the glass frit and an appropriate amount of vehicle is prepared instead of the Cu electrode paste.

Then, after coating the Ag electrode paste by a roller transfer method for a width in contact with moderate slopes 115*b*, 115*b* on both sides in the lateral direction of the groove 115 to bismuth borate type glass frit and $Cu_2O$ on the outer surface of the ferrite core comprising an Ni—Zn—Cu type ferrite and applying a heat treatment in an $N_2$ gas atmosphere at an oxygen concentration of 10 ppm or less at 850° C., 900° C. can withstand a tensile strength up to 20 kg in the same manner as the wire wound electronic part 110 of the comparative example having the terminal electrodes 116A, 116B formed with the Ni plating layer and the Sn plating layer successively on the Ag conduction layer. Further, the peel mode in a case of exerting a tensile strength exceeding 14 kg is due to internal fracture of the lower flange 11*c* of the ferrite core 11 in the same manner as in the specimen No. 6 wire wound electronic part 110 of comparative example having the terminal electrodes 116A, 116B formed with the Ni plating layer 116*b*, and the Sn plating layer 116*c* successively on the Ag conduction layer 116*a*.

As described above, it has been found that the wire wound electronic part 10 of certain embodiments has high peel strength identical with that of the existent wire wound electronic part 110 having the terminal electrodes 116A, 116B formed with the Ni plating layer 116*b*, Sn plating layer 116*c* successively on the Ag conduction layer 116*a* without forming the plating layer.

The foregoing embodiments are suitable to the wire wound electronic part used for mobile type electronic equipments or thin electronic equipments.

The foregoing description details certain embodiments of the invention. It will be appreciated, however, that no matter how detailed the foregoing appears in text, the invention may be practiced in many ways. It should be noted that the use of particular terminology when describing certain features or aspects of the invention should not be taken to imply that the terminology is being re-defined herein to be restricted to including any specific characteristics of the features or aspects of the invention with which that terminology is associated.

While the above detailed description has shown, described, and pointed out novel features of the invention as applied to various embodiments, it will be understood that various omissions, substitutions, and changes in the form and details of the device or process illustrated may be made by those skilled in the technology without departing from the spirit of the invention. The scope of the invention is indicated by the appended claims rather than by the foregoing description. All changes which come within the meaning and range of equivalency of the claims are to be embraced within their scope.

What is claimed is:

1. A wire wound electronic part comprising:

a ferrite core having a columnar core and flanges formed at both ends thereof;

a coil conductor wound around the ferrite core; and at least a pair of terminal electrodes each having a Cu conduction layer disposed on and covering an outer surface of the flange, in which both ends of the coil conductor wound around the core are conductively connected on the terminal electrodes, wherein at least one of the terminal electrodes has no plating layer and further comprises a reaction layer formed at and extending over a boundary between the Cu conduction layer and the outer surface of the flange, said reaction layer is formed from an electrode paste containing a Cu powder and a glass frit and a portion of the ferrite core, wherein the reaction layer comprises a first ferrite containing Cu and having a Zn-rich spinel structure relative to a second ferrite, the second ferrite containing Cu and having an Fe-rich spinel structure relative to the first ferrite, and a glass component in a mixed state; and the Cu conduction layer and the ferrite core are bonded at least by one of the first or second ferrite.

2. The wire wound electronic part according to claim 1, wherein the reaction layer is a layer formed by a chemical reaction between the glass frit contained in the electrode paste and a portion of the ferrite core reaction, wherein the reaction layer mainly comprises the ferrite and the glass mixed with each other.

3. The wire wound electronic part according to claim 2, wherein the reaction layer has a region of bonding the ferrite core and the Cu conduction layer by the ferrite.

4. The wire wound electronic part according to claim 1, wherein the ferrite constituting the ferrite core is an Ni—Zn type ferrite and the glass frit is a glass frit containing boron and zinc.

5. The wire wound electronic part according to claim 1, wherein the heat treatment for the ferrite core after coating the electrode paste on the outer surface is a heat treatment conducted in an $N_2$ gas atmosphere at an oxygen concentration of about 10 ppm or less at about 850 to 900° C.

6. The wire wound electronic part according to claim 1, wherein the spinel structure of the first and second ferrites is $(Ni, Zn)Fe_2O_4$.

7. The wire wound electronic part according to claim 1, wherein the reaction layer further comprises metal oxide.

8. The wire wound electronic part according to claim 7, wherein the metal oxide is selected from the group consisting of CaO, BaO, MgO, CuO, and $Cu_2O$.

9. The wire wound electronic part according to claim 1, wherein the bonding between the Cu conduction layer and the ferrite core withstands a tensile strength up to 20 kg.

10. A method of forming a wire wound electronic part comprising:

providing a ferrite core having a columnar core and flanges formed at both ends thereof;

winding a coil conductor around the ferrite core; and forming a terminal electrode by coating an electrode paste containing a Cu powder and a glass frit to the outer surface of the ferrite core; and applying a heat treatment to the ferrite core to form a reaction layer formed at and extending over a boundary between the Cu conduction layer and the outer surface of the flange, wherein the reaction layer comprises a first ferrite containing Cu and having a Zn-rich spinel structure relative to a second ferrite, the second ferrite containing Cu and having a Fe-rich spinel structure relative to the first ferrite, and a glass component in a mixed state; and the Cu conduction layer and the ferrite core are bonded at least by one of the first or second ferrite.

11. The method according to claim 10, wherein the ferrite constituting the ferrite core is an Ni—Zn type ferrite and the glass frit is a glass frit containing boron and zinc.

12. The method according to claim 10, wherein the heat treatment for the ferrite core after coating the electrode paste on the outer surface is a heat treatment conducted in an $N_2$ gas atmosphere at an oxygen concentration of about 10 ppm or less at about 850 to 900° C.

* * * * *